US005370381A

United States Patent [19]

Winship et al.

[11] Patent Number: 5,370,381

[45] Date of Patent: Dec. 6, 1994

[54] FRICTION RETARD SHEET SEPARATOR AND FEEDER HAVING REDUCED NOISE

[75] Inventors: Bruce A. Winship, Rochester; Donald E. Johnston, Penfield; Richard C. Benton, Ontario, all of N.Y.

[73] Assignee: Xerox Corporation, Stamford, Conn.

[21] Appl. No.: 199,418

[22] Filed: Feb. 22, 1994

[51] Int. Cl.[5] ..... B65H 3/52

[52] U.S. Cl. ..... 271/121; 271/124

[58] Field of Search ..... 271/121, 124, 125

[56] References Cited

U.S. PATENT DOCUMENTS

| | | | |
|---|---|---|---|
| 4,660,963 | 4/1987 | Stemmle | 355/24 |
| 5,163,668 | 11/1992 | Winship et al. | 271/121 |

FOREIGN PATENT DOCUMENTS

| | | | |
|---|---|---|---|
| 458619 | 11/1991 | European Pat. Off. | 271/121 |
| 28437 | 1/1990 | Japan | 271/121 |
| 55236 | 2/1992 | Japan | 271/121 |
| 162876 | 6/1993 | Japan | 271/121 |

*Primary Examiner*—Robert P. Olszewski
*Assistant Examiner*—Boris Milef

[57] ABSTRACT

A retard assembly for use in a friction retard separator feeder has a retard member, a support member for supporting the retard member, the retard assembly being mountingly engageable with a pivoting support frame for supporting the retard assembly at a first end of the pivot support frame and having a pivot point at its opposite end and substantially remote from the first end, the retard member support member having at least one mounting hub for mounting a locating pivot pin, which is engageable with the first end of the pivoting support frame, the retard member support member including at least one energy absorbing damping pad on the at least one mounting hub to absorb vibration of the retard pad between the retard member support member and the pivoting support frame when they are engaged, the energy absorbing damping pad being of a hardness sufficient to maintain an interference fit between the at least one mounting hub and the pivoting support frame to resist a permanent set.

16 Claims, 7 Drawing Sheets

FRICTION RETARD SHEET SEPARATOR AND FEEDER HAVING REDUCED NOISE

BACKGROUND OF THE INVENTION

The present invention relates generally to sheet feeding and separating apparatus and more particularly to a retard member for use in a friction retard sheet separator feeder which has a stable coefficient of friction, a stable feed angle and provides a very quiet sheet separation for a variety of different weight sheets. It has a particular application in the feeding of sheets in electrostatographic printing machines such as, for example, those illustrated in U.S. Pat. No. 4,660,963 to Stemmle.

The development of electrostatographic printing machines has brought about the need for simple, yet reliable, sheet separator feeder apparatus capable of handling sheets varying in length, thickness, weight and surface conditions. One of the more common arrangements involves friction retard feeders wherein separation and feeding is dependent upon a differential friction principle. In one such type of feeder, a feed roller surface has a relatively high coefficient of friction with paper while the retarding surface which may also be a roller driven in the opposite direction or alternatively a stationary pad having a coefficient of friction with paper less than that of the feed roller, but greater than that between two successive sheets of paper. In these feeders, the coefficient of friction of the feed roller with the paper must exceed the coefficient of friction of the retard member which must always exceed that of the coefficient of friction between two sheets of paper. In these separator feeders the region of contact between the retarding member and the feed roll forms a sheet queuing throat which is able to fan out or que sheets in the throat for feeding single sheets through the throat.

FIG. 1 schematically illustrates a typical sheet separator feeder apparatus capable of handling sheets varying in length, thickness, weight, and surface conditions which includes a sheet support platform 10 urged upwardly by spring 11 to advance sheets to be separated and fed to the friction retard nip formed between the retard member 12 and feed roll 13 The feed roller surface has a relatively high coefficient friction with the paper while the retard member has a lower coefficient of friction with the paper but its coefficient of friction with the paper is greater than the coefficient of friction between two successive sheets. This relationship and geometry enables the shingling or staggering of individual sheets into the nip between the feed roll and retard pad to the path defined by the sheet guide 15. Typically the feed roll is made from a silicone rubber or other elastomer having a coefficient of friction greater than about 1.5. While capable of performing satisfactorily, there are problems associated with these types of feeders. One of the more common problems is feeding reliability, that is the feeding of single sheets only from the nip between the feed roller and the retard member rather than a multi-feed of from two up to perhaps six sheets The multi-feed difficulty can be further appreciated with reference to FIG. 2, wherein a friction retard sheet separator feeder is provided which has a rigid and fixed sheet entrance guide to guide sheets into the sheet retard nip area. The multi-sheet feed situation occurs in the entrance guide area A in advance of the retard nip area B by a slug, six or more sheets, entering the entrance guide area which become pinched between the entrance guide and the feed wheel. Because the entrance guide is rigid and fixed, an additional normal force N is created between the entrance guide and the feed wheel, which creates a increased driving force to drive the slug through the retard nip creating a situation that overpowers the retard systems ability to frictionally separate the slug. In addition, lead edge damage from sheet stubbing is caused by the relatively large distance between the end of entrance guide area A and the entrance to the retard nip area B.

While capable of performing in an acceptable manner this feeder frequently experiences misfeeds and multifeeds as a result of big changes in the feed angle which result from small changes in the feed roll diameter or the retard pad thickness. Accordingly, it is desirable to provide a greater stability in the feed angle in this retard paper feeder to provide increased stability.

Our U.S. Pat. No. 5,163,668 describes a retard pad assembly with a movable compliant entrance guide which addresses these issues. One approach to improving the stability of the feed angle in the system described in U.S. Pat. No. 5,163,668 is to relocate the pivot point of the retard pad assembly to a point quite remote from that illustrated in U.S. Pat. No. 5,163,668 wherein the retard assembly is mounted in a frame which is pivotally mounted to a pivot point on the retard assembly and urged upwardly toward the front edge of the retard assembly against a separator feed roll by a spring. However, with the relocation of the pivot point from the retard assembly mount to a location which is quite remote, additional difficulties are frequently encountered in that a highly objectionable noise is created which resembles the scratching of chalk or a fingernail on a blackboard between the retard member support member and the pivoting support frame. Since the friction retarding surface is typically an elastomer to be discussed in greater detail hereinafter, as the sheets of the paper are fed across the elastomer, the frictional relationship between the elastomer and the paper tends to stretch the elastomer until it reaches a limit at which time the coefficient of friction between the paper and the elastomer drops dramatically. If the coefficient of friction decreases with relative velocity the stretching force will decrease below an equilibrium force when slippage occurs. This causes oscillation of the elastomer known as stick-slip. This oscillation excites the paper like a loudspeaker.

SUMMARY OF THE INVENTION

In accordance with a principle aspect of the present invention a retard assembly and a friction sheet separator feeder are provided, which provides high reliability of sheet feeding and in particular, minimizes difficulties associated with noise during sheet separation.

In a further principle aspect of that present invention the retard assembly includes a retard member, a support member for supporting the retard member which is mountingly engageable with a pivoting support frame for supporting the retard assembly at a first end and having a pivot point at its opposite end and substantially remote from the first end with the retard member support member having at least one mounting hub for mounting a pivot pin which is engageable with the first end of the pivoting support frame and also including at least one energy absorbing damping pad on the at least one mounting hub to absorb vibration of the retard member between the retard member support member and the pivoting support frame when they are engaged.

The energy absorbing dampening pad being of a hardness sufficient to maintain an interference fit between the at least one mounting hub and the pivoting support frame to resist a permanent set.

In the further aspect of the present invention the pivot pin is retainably engageable with mounting grooves on both sides of the pivoting support frame.

In the further aspect of the present invention the locating pivot pin extends perpendicular to the sheet feeding direction through the retard member support member and there is one mounting hub at each end of the retard member support member that the locating pivot pin extends through the mounting hubs and the energy absorbing damping pads are mounted on the mounting hubs to provide the interference fit with the pivoting support frame when engaged with the pivoting support frame.

In a further aspect of the present invention the damping material is selected to provide an interference fit between the retard pad mounting hub and the pivoting support frame of from about 1.0 to 1.50 mm and has a Shore A durometer of from about 50 to 60.

In a further aspect of the present invention mounting means such as integrally molded tabs are provided on the support member and mounting coupling having channels which engage the mounting tabs are provided on the sheet entrance guide.

DESCRIPTION OF PREFERRED EMBODIMENT

Figure 1:
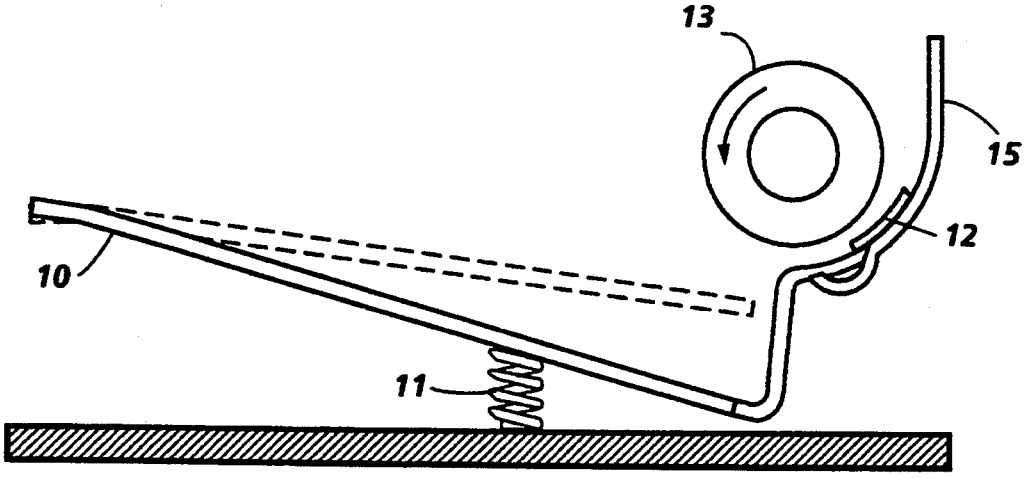
FIG. 1 PRIOR ART
FIG. 1 is a schematic representation in cross section of a friction retard separator, and feeder according to the present invention.
Figure 2:
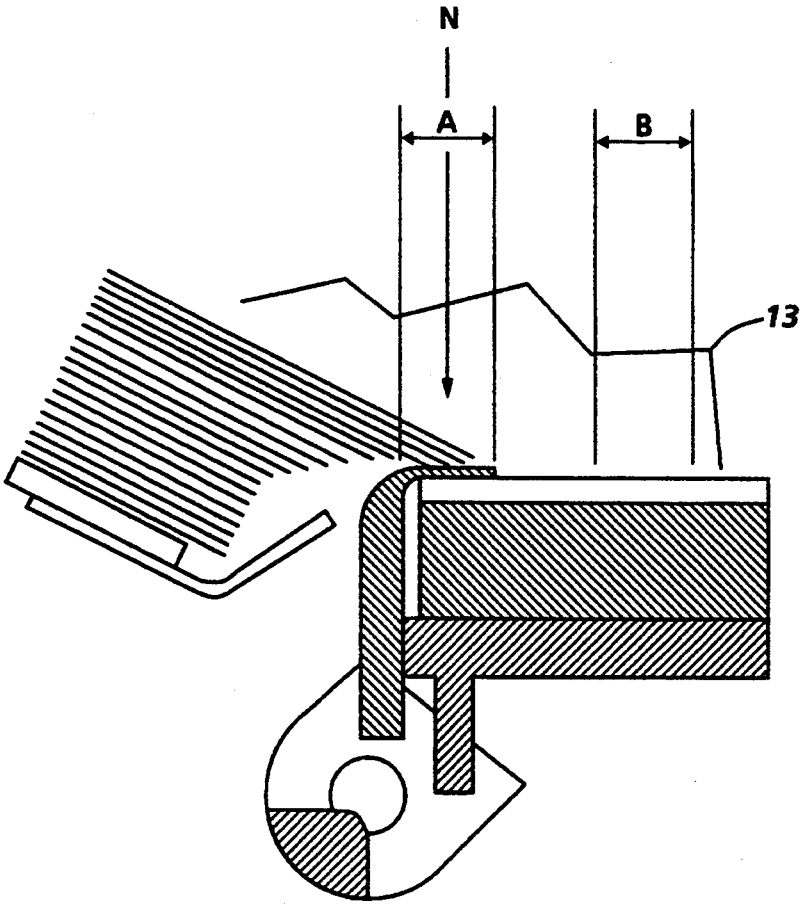
FIG. 2 PRIOR ART
FIG. 2 is a schematic representation of a sheet separator feeder according to prior art practices.
Figure 3A:
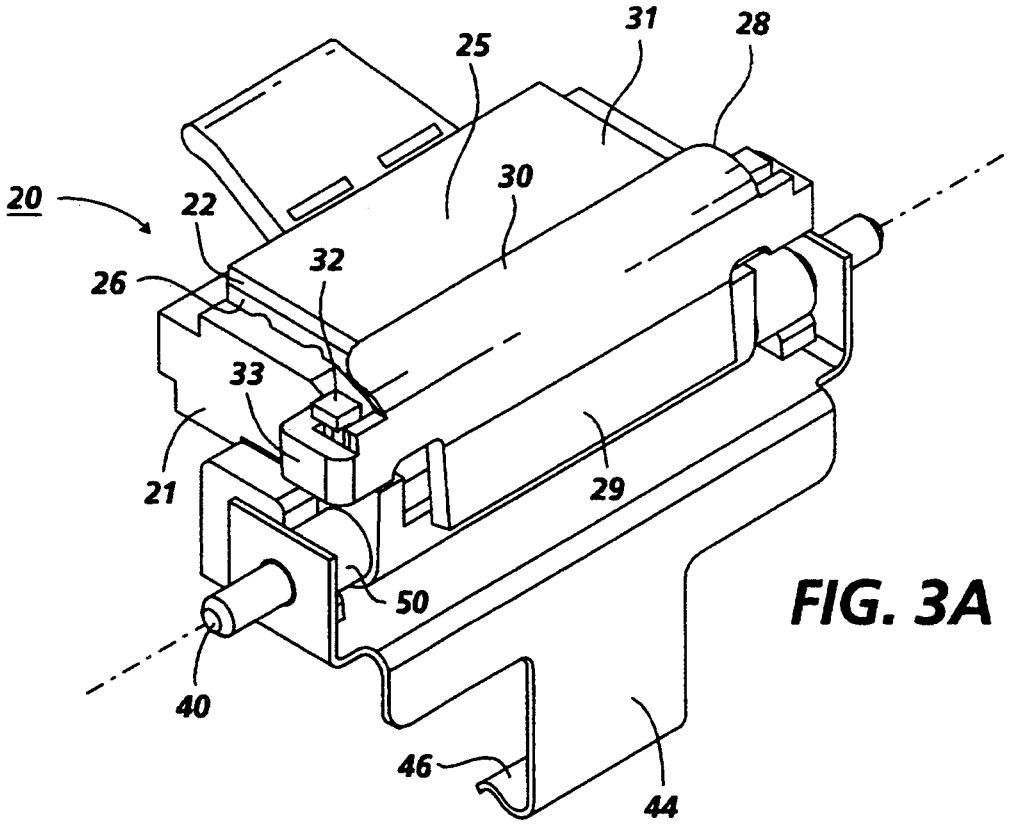
FIGS. 3A and 3B are front and rear isometric views of the retard assembly according to the present invention.
Figure 3B:
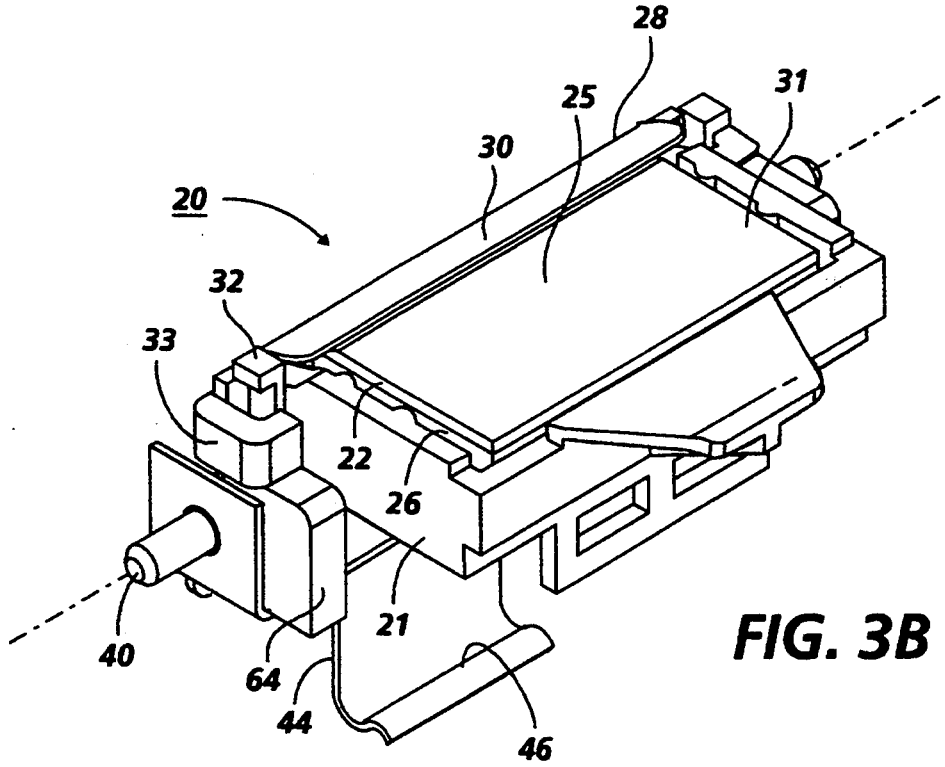
Figure 4A:
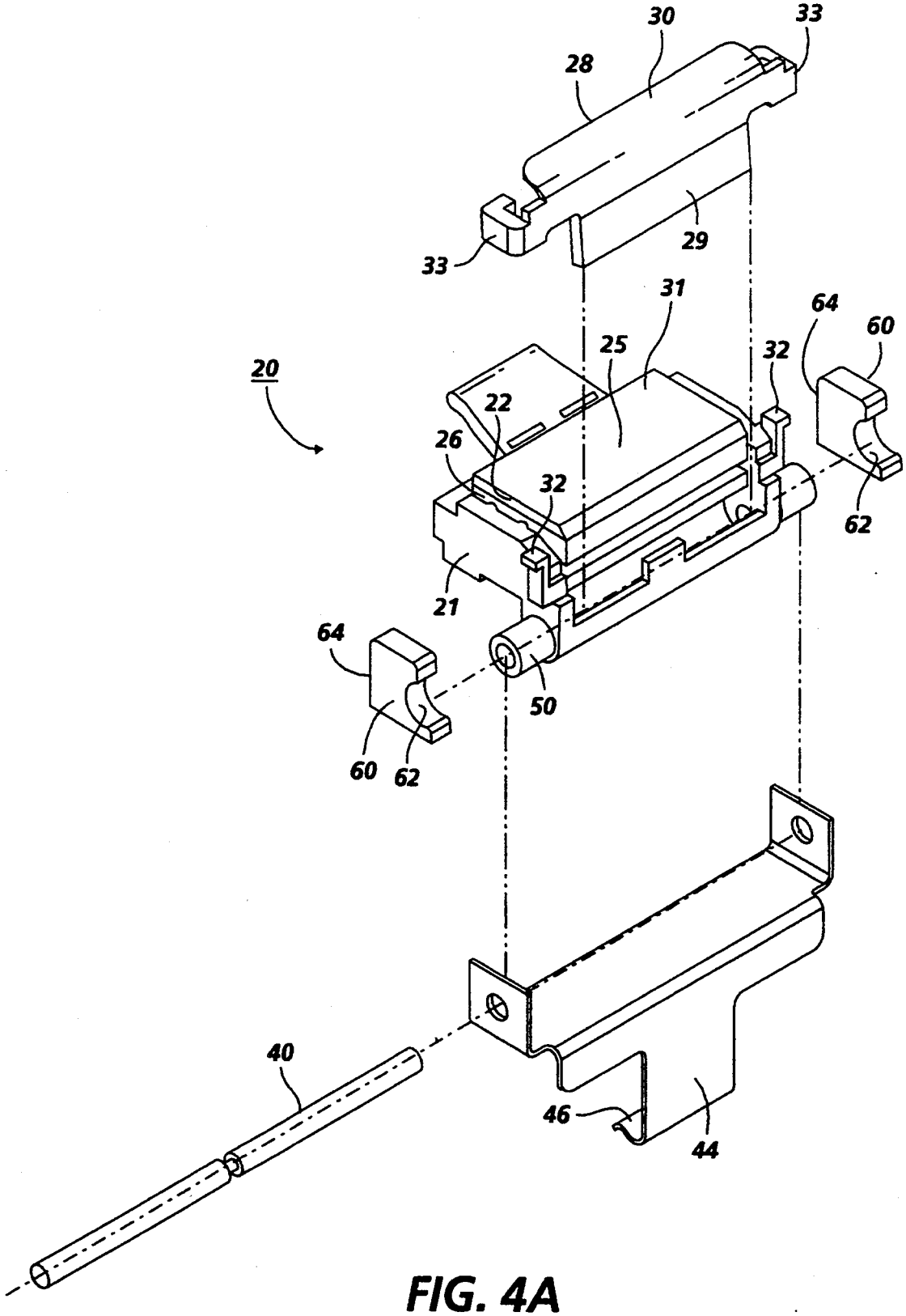
FIGS. 4A and 4B are exploded isometric front and rear views or the retard assembly according to the present invention.
Figure 4B:
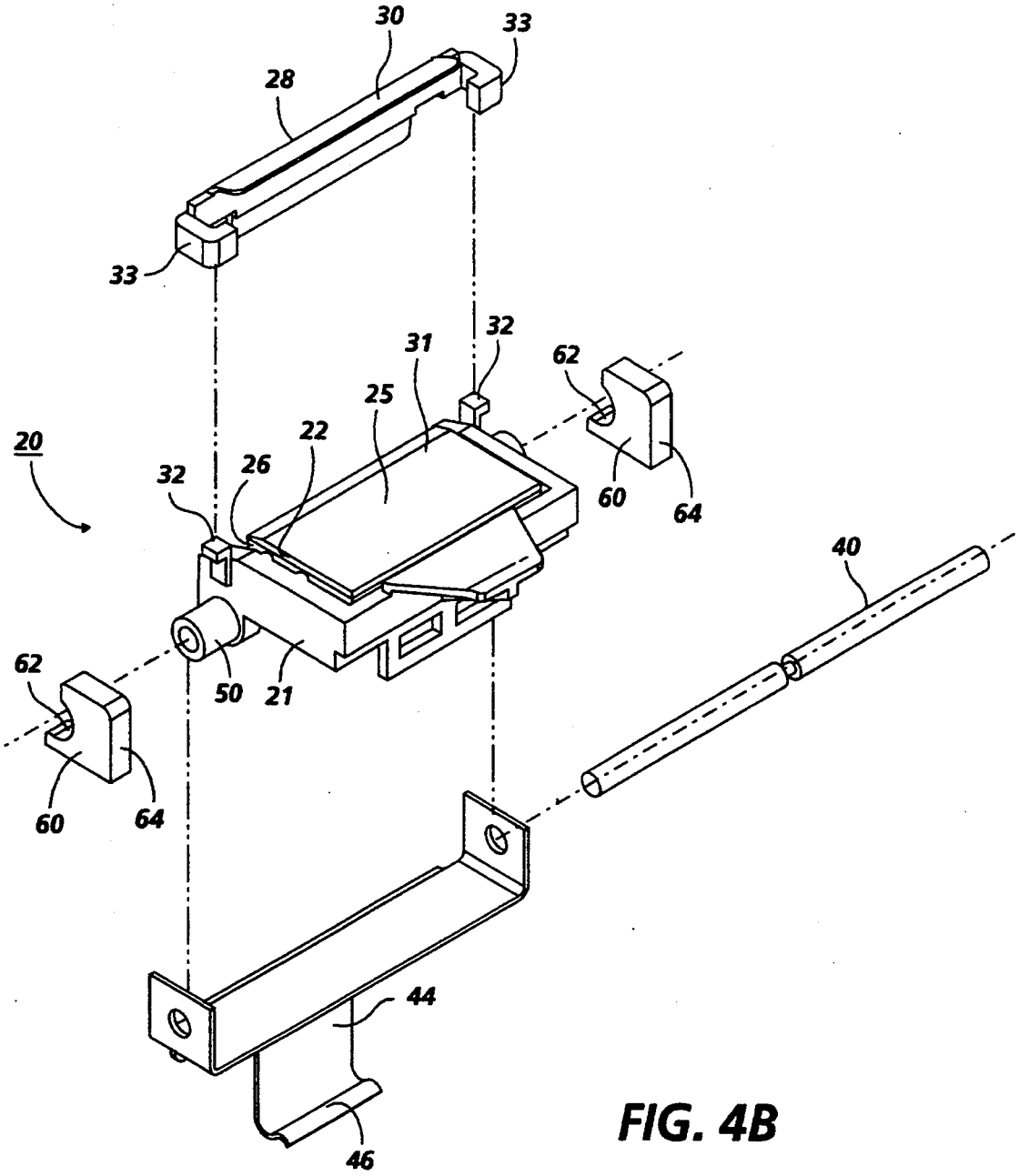
Figure 5:
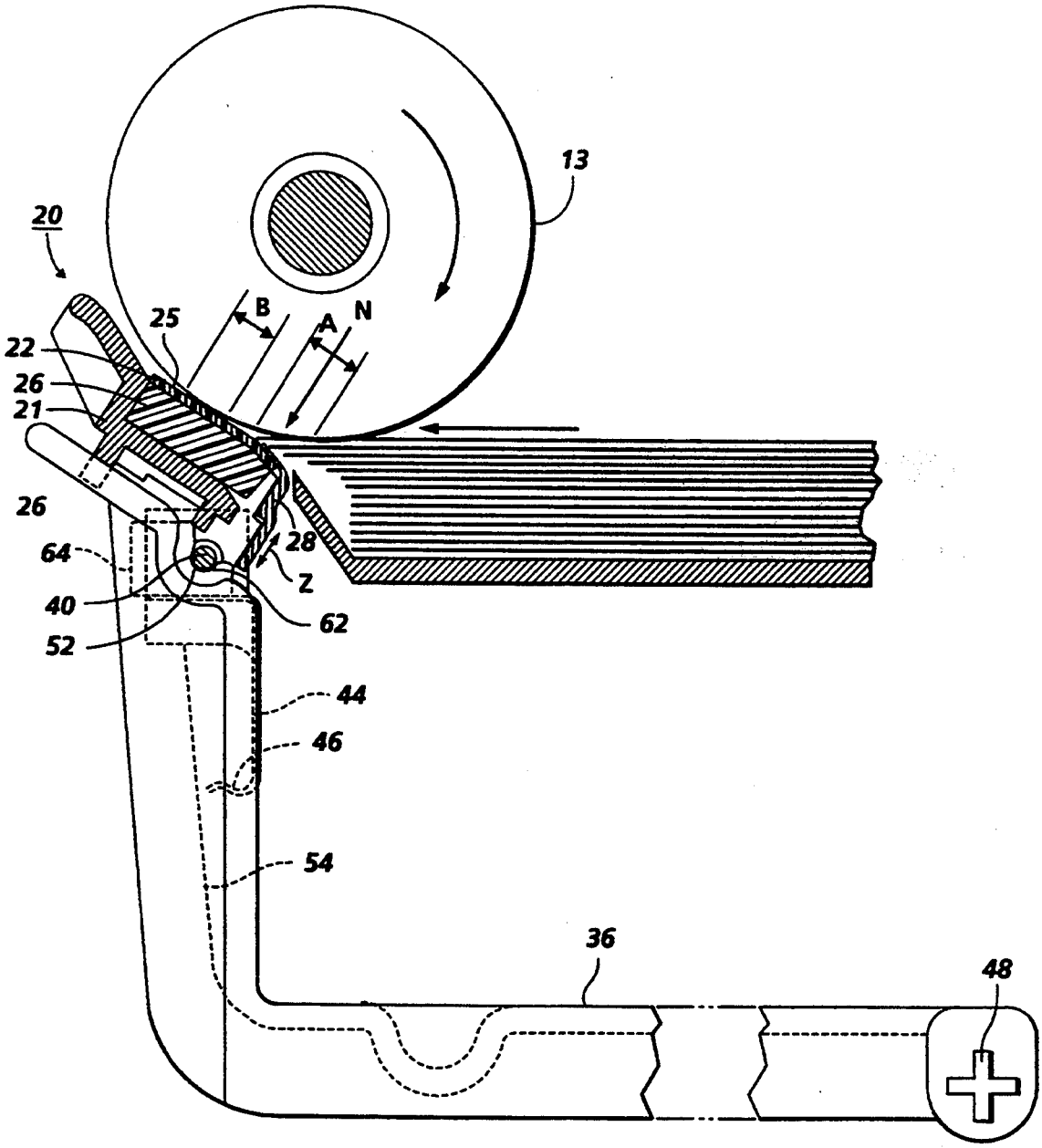
FIG. 5 is a sectional view illustrating the retard assembly according to the present invention mounted to the pivot support frame.
Figure 6:
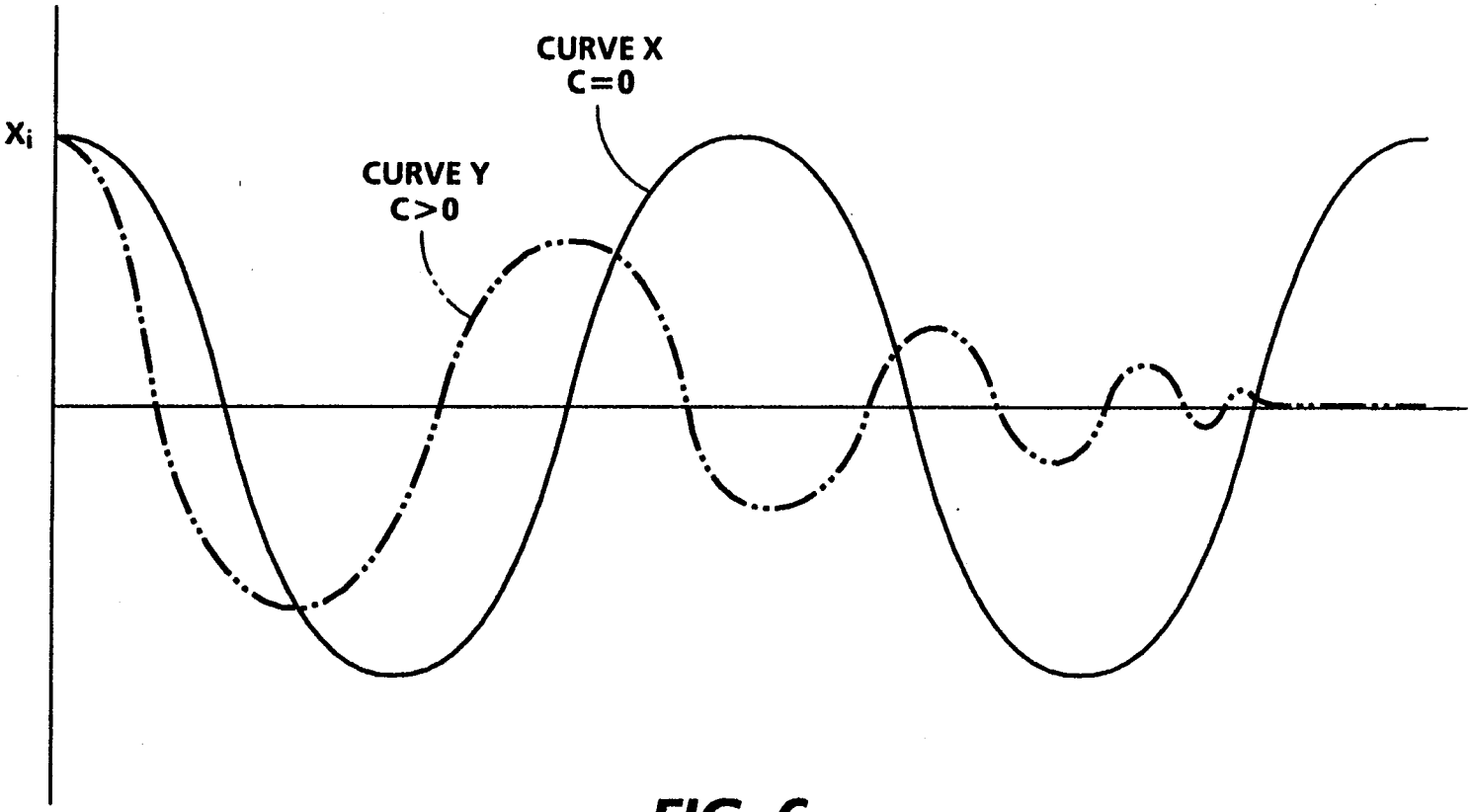
FIG. 6 is a damping profile of a system wherein the coefficient of damping in Curve X is 0 and the coefficient of damping in Curve Y is greater than 0.

As seen with reference to FIGS. 3A, 3B, 4A, 4B, 5 and 6 the retard assembly 20 comprises a support member 21 which supports a retard member 22 comprising a top friction retarding surface layer 25 having a stable coefficient of friction and an intermediate vibration absorption layer 26. The vibration absorption layer 26 may be secured to the support member 21 by any suitable means such as with a conventional adhesive for example, an acrylic adhesive like the cyanoacrylote, Loctite 454. The friction retarding surface layer 25 is secured to the vibration absorption layer in a similar fashion. The support member 21 also supports a sheet entrance guide 28 which has a surface with a low coefficient of friction and has a substantially vertical portion 29 and a substantially horizontal portion, 30 which overlies a portion 31 of the friction retard surface layer. The sheet entrance guide 28 which is normally urged upwardly by the vibration absorption layer 26 and the friction retarding surface layer 25 is vertically compliant and movable in the support member 21 by suitable mounting means such as tabs 32 on each side of the support member and cooperative mounting means such as coupling 33 having channels to enable the sheet entrance guide to move vertically on the tabs. There is a void between the vertical portion of the sheet entrance guide and the top friction retarding surface layer 25 and the intermediate vibration absorption layer with the void adjacent the vibration absorption layer being larger than that adjacent the retarding surface layer. This void enables the sheet entrance guide to be vertically compliant as indicated by the bidirectional arrow illustrated in FIG. 5 and to also be somewhat flexible in a direction normal to the bidirectional arrow and facilitate a mode of operation which overcomes the multi-sheet feed problem noted above by replacing a high spring rate, fixed rigid guide of FIG. 2, zone A, with a compliant movable guide having a low spring rate FIG. 5, zone A, which therefore reduces the magnitude of the normal drive force when a slug of sheets enters the entrance guide area. When the slug of sheets force the compliant movable entrance guide down, there is no sudden increase in normal force. As a result the drive force driving the sheets into the retard nip is low and insufficient to drive the slug of sheets through the nip permitting the retard pad to shingle the sheets in the normal way. In this context by the term spring rate we intend to define the slope of a plot of applied force (y axis) versus displacement (x axis) force per unit of displacement as the spring rate with the fixed rigid entrance guide having a much higher spring rate than the compliant movable guide according to the invention. A significant consequence of the above structure is that the spring rate in the entrance guide area A of FIG. 5 is approximately half the magnitude of the spring rate in the retard area B.

Turning once again to FIGS. 3A, 3B, 4A, 4B and 5 the retard assembly 20 is mounted in a pivoting support frame 36 which pivots at its end opposite its first end about axis 48. The retard member support member 21 has mounting hubs 50 for mounting a locating pivot pin 40 which extends outside the support member hubs and engages a first end of the pivoting support frame at both sides in a grooves 52 (see FIG. 5) in the side arms 54 of the pivoting support frame. To secure the support member to the pivoting support frame a mounting clip 44 has a lip 46 which clips under the pivoting support frame 36 to hold the support member in place. As may be observed with particular reference to FIG. 5 the pivoting support frame 36 while it supports the support member 21 for the retard member 25 of the retard assembly 20 at the first end it's pivot point is at the opposite end and substantially remote from the first end. While this geometry has the effect of stabilizing the feed angle of the sheet separator/feeder it introduces as discussed above a vibration and therefore noise problem between the retard member support member and the pivoting support frame. To alleviate this vibration and noise difficulty an energy absorbing damping pad 60 is mounted on each of the mounting hubs 50 on the retard member support member 21 to maintain an interference fit between the mounting hubs 50 on the retard member support member 21 and the pivoting support frame 36.

By damping material we intend to define those materials whereby the oscillations in the vibration are progressively reduced or suppressed more quickly than in a non-damping system. This is illustrated graphically in FIG. 6 for both a system which has a 0 damping coefficient, Curve X, and a system which has a damping coefficient substantially greater than 0, Curve Y. To achieve the desired reduction in vibration and noise the damping pads are mounted on the mounting hubs to provide an interference fit with a pivoting support frame when it is engaged with a pivoting support frame. As illustrated, this is achieved by providing a damping pad 60 which has an indent 62, generally circular, to mate with the mounting hub 50 and a rear surface 64 to provide the interference fit between the mounting hub and pivoting support frame. Accordingly, the energy absorbing damping pad should be of a hardness sufficient to maintain this interference fit and to resist a permanent set. There is a balance between a hardness and interference in that for harder materials there will be less interference in the fit between the two parts and all the more difficult to. maintain the interference fit over time. Accordingly, depending on the geometry of the specific system the balance between the hardness of the damping material and interference fit must be identified. In the system herein illustrated an interference fit of 1.25 mm±0.25 mm providing a total range of 1.0 to 1.50 mm, has been found to provide suitable dampening characteristics with a damping material having a durometer of from about 50 to about 60 and preferably 55 Shore A.

Any suitable damping material may be selected based upon the above considerations. A preferred commercially available damping material is Isodamp C-1002 available from EAR Division of Cabot Corporation, Indianapolis, Ind., which is believed to be a polyvinylchloride alloy based compound containing antimony trioxide and a small amount of plasticizer dispersing agent. We have found with this damping material that any vibrations or oscillations in any accompanying noise quickly disappear.

The friction retarding surface is made from an ethylene propylene diene terpolymer rubber known as EPDM which provides a relatively stable coefficient of friction for the retarding surface and can be selected from those materials described in the above referenced Lentz et al U.S. Pat. No. 4,314,006 which is hereby incorporated by reference in its entirety herein. Such materials are commercially available from various suppliers such as Exxon Chemical Co., USA under the trade designation Vistalon 2504-099, E. I. Dupont Company under the trade designation Nordell 1440.

It is preferred to cure the EPDM in a free radical crosslinking system comprising a free radical initiator. Exemplary of such a system is a peroxide curing system. Examples of free radical initiators are dicumyl peroxide, benzyl peroxide, and di-t-butyl peroxide. It is also preferred that the ethylene propylene diene terpolymer rubber (EPDM) be cured in a process in which the free radical crosslinking is carried out in the presence of a co-agent which is a reactive monomer itself and which adds to the polymer radical formed by the free radical initiator. This type of coagent promotes trimolecular crosslinking. Triallyl cyanurate and triallyl isocyanurate are examples of such coagents which promote trimolecular crosslinking, that is, which join three, rather than merely two, polymer chains together. When triallyl cyanurate or triallyl isocyanurate is used as the coagent, about 0.5 to 3 parts, and preferably about 2 to 2.5 parts, by weight of the coagent may be used per 100 parts of EPDM. The dicumyl peroxide free radical initiator is present in amounts of about 4 to 12 parts and preferably about 8 parts.

In addition, for every 100 parts by weight of EPDM the composition may contain up to 80 parts, preferably 40 to 75 parts of various fillers and/or reinforcing agents such as silica and alumina. A lubricant such as zinc stearate may be present in amounts of from about 0.25 to two parts and preferably one part by weight. A processing aid such as zinc methacryate may be present in an amount of from 0.25 to 5 parts and preferably 1.5 parts by weight. Further 2.5 to 20 parts, preferably 5 to 10 parts, by weight of zinc oxide activator stabilizer are provided in a preferred composition. A colorant such as titanium dioxide is typically present in amounts of from 2 to 20 parts, preferably 5 to 8 parts, by weight and up to 50 parts preferably about 5 to 10 parts of a plasticizer softener such as paraffinic oil such as Sunthene 4240 available from Sun Oil Company may be present. Typically, the EPDM friction retarding surface layer has a tensile strength of at least 900 pounds per square inch, an ultimate elongation of 200 per cent ±50 per cent, a maximum compression set of 9 per cent, a tear strength of at least 95 pounds per square inch, a Shore A Durometer of between 63 and 73 and a specific gravity between 1.19 and 2.25.

The above described EPDM composition provides a stable and controllable coefficient of friction for the friction retarding surface layer and in particular one wherein the coefficient of friction is relatively stable at about 1.2 with nominal variation within plus or minus 0.2. In addition, the EPDM terpolymer is resistant to abrasion and surface cracking as well as being resistant to ozone attack and exposure to ultraviolet light.

The vibration absorption layer is a closed cell polychloroprene foam which provides sufficient dampening to the retarding surface layer to reduce the noise otherwise generated from the stick slip phenomenon when feeding relatively heavy paper and transparencies. The polychloroprene foam supplies a spring rate or constant that allows the retard member to deflect at a steady rate without vibration. Further the polychoroprene foam tends to isolate any vibration in the retard member so that it is not transmitted to the frame. The polychoroprene is an elastomer made by the vulcanization of 2-chlorol-1,3-butadiene with metal oxides rather than sulfur. The 2 clorol-1,3-butadiene is prepared by the action of hydrogen chloride on monoviny-acetylene.

The expanded polychloroprene has a uniform closed cell structure and is free from cracks or tears or other surface defects which will be detrimental to its function. The closed cell nature of the foam enables bonding at the surface of the foam to the mount and the surface layer without adhesive penetrating the surface to affect the properties of the foam. The foam may have a skin on all surfaces or each surface may be free from skin. When the skin is used it is of the same compound and vulcanized intricately with the cellular structure. The foam typically has an apparent density between 12 and 22 pounds per cubic foot, a compression force deflection of between 5 and 9 pounds per square inch, a tensile strength of at least 70 pounds per square inch, an ultimate elongation of at least 130 percent, a maximum compression set after 24 hours at 23° C. of 25 percent after 24 hours at 50° C. of 40 percent and Shore 00 Durometer between 40 and 60. Such a polychloroprene foam enables control of the spring force at a steady rate in response to deflection by the force of the feed roll in the separating feeding nip. Typical commercially available materials includes the polychloroprene foam R-425-N available from Rubatex Corp.; Bedford, Va. and 4219-N available from American National Rubber Co., Huntington, W. Va.

The retard member may be assembled in any suitable fashion. Typically the vibration absorption layer is glued to the support member with a suitable adhesive such as the Loctite 454 previously mentioned when the support member is a plastic. Similarly the EPDM friction retarding surface layer may be glued to the polychloroprene foam layer with the same adhesive. Particularly satisfactory results in reducing the noise created by the stick slip phenomenon have been achieved with a retard member wherein the vibration absorption layer is from about 4 to about 6 times as thick as the friction retarding surface layer. This provides a retard member having a sufficiently thick foam layer to absorb the vibration and thin enough to control deformation under load.

Typically, the friction retarding surface layer is of the order of 0.75 to 1.0 millimeters thick and the vibration absorption layer is of the order of 3 to 6 millimeters thick. In a preferred embodiment the friction retarding surface layer is 0.85 millimeters thick and the vibration absorption layer is from 4 to 4.8 millimeters thick.

Thus, according to the present invention, a novel retard assembly as well as a sheet separator feeder has been provided wherein a totally unacceptable level of noise created by the vibration of the retard member support member and the pivoting support is substantially reduced to a level at least acceptable to the human ear, if not in many instances completely eliminated. This is accomplished by providing energy absorbing damping pads between the retard member support member and the pivoting support frame of a hardness sufficient to maintain an interference fit between the support frame and the pivoting support frame to resist a permanent set. Furthermore, the present retard assembly and sheet separating and feeding device solves the problem associated with multifeeds or slug feeds in prior art devices. For further details concerning these improvements, attention is directed to our U.S. Pat. No. 5,163,668 which hereby totally and completely incorporated by reference herein.

The patents referred to herein are hereby specifically totally and completely incorporated herein by reference.

While the present invention has been described with reference to the specific embodiments described herein it will be apparent that many alternatives, modifications and variations may be made by those skilled the art. For example, while the invention has been illustrated with the friction feed member as a roll it could equally well be a belt. Accordingly it is intended to embrace all such alternatives and modifications as may fall within the spirit and scope of the appended claims.

We claim:

1. A retard assembly for use in a friction retard separator feeder comprising a retard member, a support member for supporting said retard member, said retard assembly being mountingly engageable with a pivoting support frame for supporting said retard assembly at a first end of said pivoting support frame and having a pivot point at its opposite end and substantially remote from said first end, said retard member support member having at least one mounting hub for mounting a locating pivot pin, said pivot pin being engageable with the first end of the pivoting support frame, said retard member support member including at least one energy absorbing damping pad on said at least one mounting hub to absorb vibration of the retard member between the retard member support member and the pivoting support frame when they are engaged, said energy absorbing damping pad being of a hardness sufficient to maintain an interference fit between said at least one mounting hub and said pivoting support frame to resist a permanent set.

2. The retard assembly of claim 1 wherein said pivot pin is retainably engageable with mounting grooves on both sides of said pivoting support frame.

3. The retard assembly of claim 1 wherein said locating pivot pin extends through said retard member support member perpendicular to the sheet feeding direction, that one mounting hub is at each end of said retard member support member, that the locating pivot pin extends through said mounting hubs, that energy absorbing damping pads arc mounted on said mounting hubs to provide said interference fit with said pivoting support frame when engaged with said pivoting support frame.

4. The retard assembly of claim 1 wherein the damping material of said damping pad is selected to provide an interference fit between the mounting hub and the pivoting support frame of from about 1.0 to 1.50 mm.

5. The retard assembly of claim 4 wherein the damping material has a Shore A durometer of from about 50 to 60.

6. The retard assembly of claim 1 including a sheet entrance guide at the incoming end of the retard assembly having a substantially vertical portion and a substantially horizontal portion overlying an incoming guide entrance portion of the retard member in advance of the retard portion of the retard member, said sheet guide being vertically compliant and movable in said support member to enable reduction in the spring rate in the entrance guide portion of the retard member to a level substantially below the level in the retard portion.

7. The retard assembly of claim 1 wherein said retard member comprises a top friction retarding surface layer having a stable coefficient of friction and an intermediate vibration absorption layer between said support member and said surface layer.

8. The retard assembly of claim 6 wherein said sheet entrance guide has a surface having a low coefficient of friction.

9. A friction retard sheet separator and feeder comprising a sheet support platform for supporting a stack of sheets, sheet feed means mounted for sheet feeding engagement with the top sheet of a stack of sheets when a stack of sheets is on said sheet support platform and a retard assembly mounted for engagement with said sheet feed means to form a separating nip therebetween for separating any overlapped sheets from reaching the nip, said retard assembly comprising a retard member, a support member for supporting said retard member, said retard assembly being mountingly engageable with a pivoting support frame for supporting said retard assembly at a first end of said pivoting support frame and having a pivot point at its opposite end and substantially remote from said first end, said retard member support member having at least one mounting hub for mounting a locating pivot pin, said pivot pin being engageable with the first end of the pivoting support frame, said retard member support member including at least one energy absorbing damping pad on said at least one mounting hub to absorb vibration of the retard member between the retard member support member and the pivoting support frame when they are engaged, said energy absorbing damping pad being of a hardness sufficient to maintain an interference fit between said at least one mounting hub and said pivoting support frame to resist a permanent set.

10. A friction retard sheet separator and feeder according to claim 9 wherein said pivot pin is retainably engageable with mounting grooves on both sides of said pivoting support frame.

11. A friction retard sheet separator and feeder according to claim 9 wherein said locating pivot pin extends through said retard member support member perpendicular to the sheet feeding direction, that one mounting hub is at each end of said retard member support member, that the locating pivot pin extends through said mounting hubs, that energy absorbing damping pads are mounted on said mounting hubs to provide said interference fit with said pivoting support frame when engaged with said pivoting support frame.

12. A friction retard sheet separator and feeder according to claim 9 wherein the damping material of said damping pad is selected to provide an interference fit between the mounting hub and the pivoting support frame of from about 1.0 to 1.50 mm.

13. A friction retard sheet separator and feeder according to claim 9 wherein the damping material of said damping pad has a Shore A durometer of from about 50 to 60.

14. A friction retard sheet separator and feeder according to claim 9 wherein said retard member comprises a top friction retarding surface layer having a stable coefficient of friction and an intermediate vibration absorption layer between said support member and said surface layer.

15. A friction retard sheet separator and feeder according to claim 9 including a sheet entrance guide at the incoming end of the retard assembly having a substantially vertical portion and a substantially horizontal portion overlying an incoming guide entrance portion of the retard member in advance of the retard portion of the retard member, said sheet guide being vertically compliant and movable in said support member to enable reduction in the spring rate in the entrance guide portion of the retard member to a level substantially below the level in the retard portion.

16. A friction retard sheet separator and feeder according to claim 15 wherein said sheet entrance guide has a surface having a low coefficient of friction.

* * * * *